US007538076B2

(12) United States Patent
Brown et al.

(10) Patent No.: US 7,538,076 B2
(45) Date of Patent: May 26, 2009

(54) LUBRICANT AND CONCENTRATE COMPOSITIONS COMPRISING HINDERED-PHENOL-CONTAINING DIESTER ANTIOXIDANT AND METHOD THEREOF

(75) Inventors: Jason R. Brown, North Ridgeville, OH (US); Jonathan S. Vilardo, Willoughby, OH (US); Virginia A. Carrick, Chardon, OH (US); William D. Abraham, Concord Township, OH (US); Paul E. Adams, Willoughby Hills, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 618 days.

(21) Appl. No.: 11/091,177

(22) Filed: Mar. 28, 2005

(65) Prior Publication Data

US 2006/0217274 A1 Sep. 28, 2006

(51) Int. Cl.
*C10L 1/22* (2006.01)

(52) U.S. Cl. ..... 508/477

(58) Field of Classification Search ..... 508/477
See application file for complete search history.

(56) References Cited

U.S. PATENT DOCUMENTS

| | | | | |
|---|---|---|---|---|
| 3,285,855 A | | 11/1966 | Dexter et al. | 252/57 |
| 3,644,482 A | | 2/1972 | Dexter et al. | 260/473 R |
| 3,779,945 A | * | 12/1973 | Dexter et al. | 252/404 |
| 3,880,910 A | | 4/1975 | Spivack et al. | 260/473 S |
| 4,720,517 A | | 1/1988 | Ravichandran et al. | 524/101 |
| 5,206,414 A | | 4/1993 | Evans et al. | 560/75 |
| 5,595,964 A | * | 1/1997 | Bardasz | 508/423 |
| 6,074,995 A | | 6/2000 | Dohner | 508/460 |
| 6,114,288 A | * | 9/2000 | Fujitsu et al. | 508/371 |
| 6,559,105 B2 | | 5/2003 | Abraham et al. | 508/186 |
| 6,572,847 B2 | | 6/2003 | Abraham et al. | 424/76.21 |
| 6,756,348 B2 | | 6/2004 | Palazzotto et al. | 508/503 |

FOREIGN PATENT DOCUMENTS

| | | |
|---|---|---|
| GB | 2020866 A | 3/1980 |
| WO | WO 03/051816 | 6/2003 |

OTHER PUBLICATIONS

Derwent Abstract, Accession No. 1985:439461 HCAPLUS, Document No. 103:39461, "Use of a Chemiluminescence Method for Studying Thermal-Oxidative Stability of Oils" (Source: Deposited Doc. (1984), VINITI 3201-84, 213-16; RU Report, Author: Lebedev, V.S.).

Derwent Abstract, Accession No. 1985:222996 HCAPLUS, Document No. 102:222996, "Stabilization of T-6 Fuel with Antioxidant" (Source: Khimiya I Teknologiya Topliv I Masel (1985) (1), 16-17; RU Journal, Authors: Golubeva, I.A. et al.).

Derwent Abstract, Accession No. 1985: 169318 HCAPLUS, Document No. 102:169318, "Rapid Selection of Effective Inhibitors for Oils" (Source: Khimmotol.: Teor. Prakt. Ratsion. Ispol'z. Goryuch. Smaz. Mater. Tekh., Mater. Semin. (1983) Meeting; RU Conference, Authors: Gureev, A.A. et al.).

Derwent Abstract, Accession No. 1984:88279 HCAPLUS, Document No. 100:88279, "Evaluation of the Effectiveness of Lubricating Oil-Oxidation Inhibitors by Chemiluminescence" (Source: Izvestiya Vysshikh Uchebnykh Zavedenii, Neft I Gaz (1983), 26 (9), 42-44; RU Journal, Authors: Gureeva; A.A. et al.).

PCT Search Report for corresponding International Application No. PCT/US2006/011119; date of mailing search report: Nov. 2, 2006.

* cited by examiner

*Primary Examiner*—Walter D Griffin
*Assistant Examiner*—Frank C Campanell
(74) *Attorney, Agent, or Firm*—Christopher D. Hilker; David M. Shold

(57) ABSTRACT

A lubricant and concentrate composition comprises a hindered-phenol-containing diester antioxidant derived from a hydrocarbyl diol or an amide diol. A method for improving the performance of a lubricant composition, especially a lubricant composition for an internal combustion engine, comprises the antioxidant.

14 Claims, No Drawings

LUBRICANT AND CONCENTRATE COMPOSITIONS COMPRISING HINDERED-PHENOL-CONTAINING DIESTER ANTIOXIDANT AND METHOD THEREOF

BACKGROUND OF THE INVENTION

The present invention relates to compositions suitable for use as lubricant additives which contain an ester-substituted hindered phenol antioxidant and other additives suitable for lubricants such as a detergent or a dispersant. The present invention provides an economical antioxidant which has good performance properties when used in lubricant formulations especially for heavy duty diesel engines and passenger car crankcase engines.

Antioxidants are an important class of additives since they are used to provide and/or improve the antioxidation performance of organic compositions, including lubricant compositions that contain organic components, by preventing or retarding oxidative and thermal decomposition. Antioxidants in some applications can result in an increase in volatility which can be undesirable due to required environmental regulations and/or performance standards.

It is known to use a hindered, ester-substituted phenol antioxidant in an oil of lubricating viscosity to reduce oxidation breakdown and improve cleanliness.

U.S. Pat. No. 5,523,007, Kristen et al., Jun. 4, 1996, discloses a lubricant oil composition comprising a diesel engine lubricating oil and, as antioxidant, a compound of the formula

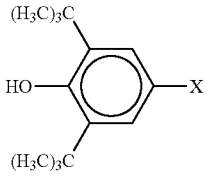

X can be —CH2—CH2—C(═O)—OR and R is a straight chain or branched alkyl radical of the formula —CnH2n+1 wherein n is an integer from 8 to 22.

U.S. Pat. No. 3,285,855, Dexter et al., Nov. 15, 1966, discloses stabilization of organic material with esters containing an alkylhydroxyphenyl group. The ester can have the structure

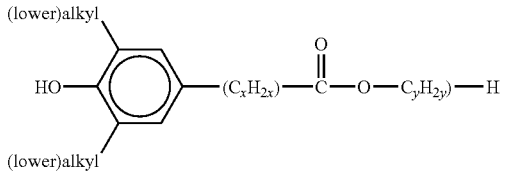

in which x has a value of from 0 to 6, inclusively, and y has a value of from 6 to 30, inclusively. The "lower alkyl" groups can be t-butyl. Organic materials which can be stabilized include, among many others, lubricating oil of the aliphatic ester type, and mineral oil.

U.S. Pat. No. 5,206,414, Evans et al., Apr. 27, 1993, discloses a process for the preparation of compounds of the general formula

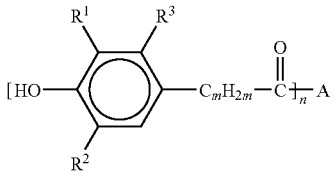

wherein R1 and R2 are identical or different and are hydrogen, C1-C18 alkyl, phenyl, C1-C4 alkyl-substituted phenyl, C7-C9 phenylalkyl, C5-C12 cycloalkyl or C1-C4 alkyl-substituted C5-C12 cycloalkyl, R3 is hydrogen or methyl, m is 0,1,2, or 3 and n is a number from 1 to 4 or 6, and A can be —OR4 where R4 can be C2-C45 alkyl.

U.S. Pat. No. 6,559,105 of Abraham et al. involves lubricant compositions containing ester-substituted hindered phenol antioxidants.

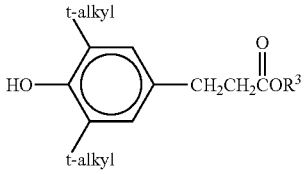

wherein R3 is an alkyl group containing 2 to 6 carbon atoms, and a dispersant or a detergent, is a useful additive package for lubricant compositions.

U.S. Pat. No. 6,787,663, Adams et al., Sep. 7, 2004 discloses a process for the preparation of a hindered ester-substituted phenol and its use in a lubricant composition of the general formula

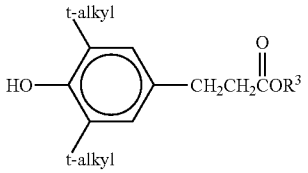

wherein R3 is an alkyl group containing 2 to 6 carbon atoms.

The present invention involves a low volatility antioxidant that can provide antioxidation performance, volatility performance, deposit performance, or a combination thereof to a lubricant composition, especially a lubricant composition for an internal combustion engine.

SUMMARY OF THE INVENTION

The present invention provides for a lubricant composition suitable for lubricating an internal combustion engine, comprising:

(A) a major amount of an oil of lubricating viscosity;

(B) a minor amount of at least one hindered-phenol-containing diester antioxidant wherein said antioxidant is formed from a 3-(3,5-di-t-alkyl-4-hydroxyphenyl)propionic acid or a reactive equivalent thereof and a diol selected from the group consisting of (1) a hydrocarbon diol compound, (2) an amide diol compound formed from a monoamine or a polyamine having at least one primary or secondary amino group and a dihydroxy-containing monocarboxylic acid or a reactive equivalent thereof, and (3) mixtures thereof; and (C) a minor amount of at least one other additive selected from the group consisting of viscosity modifiers, pour point depressants, dispersants, detergents, antiwear agents, antioxidants are different from component (B), friction modifiers, corrosion inhibitors, seal swell agents, metal deactivators, foam inhibitors, and mixtures thereof.

The present invention further provides for a lubricant concentration suitable for lubricating an internal combustion engine, comprising:

(A) a concentrate-forming amount of an oil of lubricating viscosity;

(B) at least one hindered-phenol-containing diester antioxidant wherein said antioxidant is formed from a 3-(3,5-di-t-alkyl-4-hydroxyphenyl)propionic acid or a reactive equivalent thereof and a diol selected from the group consisting of (1) a hydrocarbon diol compound, (2) an amide diol compound formed from a monoamine or a polyamine having at least one primary or secondary amino group and a dihydroxy-containing monocarboxylic acid or a reactive equivalent thereof, and (3) mixtures thereof; and (C) at least one other additive selected from the group consisting of viscosity modifiers, pour point depressants, dispersants, detergents, antiwear agents, antioxidants that are different from component (B), friction modifiers, corrosion inhibitors, seal swell agents, metal deactivators, foam inhibitors, and mixtures thereof.

The present invention further provides a method for lubricating an internal combustion engine, comprising:

(A) supplying to said engine a lubricant comprising:

(i) an oil of lubricating viscosity;

(ii) at least one hindered-phenol-containing diester antioxidant wherein said antioxidant is formed from a 3-(3,5-di-t-alkyl-4-hydroxy-phenyl) propionic acid or a reactive equivalent thereof and a diol selected from the group consisting of (1) a hydrocarbon diol compound, (2) an amide diol compound formed from a monoamine or a polyamine having at least one primary or secondary amino group and a dihydroxy-containing monocarboxylic acid or a reactive equivalent thereof, and (3) mixtures thereof; and (iii) a minor amount of at least one other additive selected from the group consisting of viscosity modifiers, pour point depressants, dispersants, detergents, antiwear agents, antioxidants that are different from component (ii), friction modifiers, corrosion inhibitors, seal swell agents, metal deactivators, foam inhibitors, and mixtures thereof.

DETAILED DESCRIPTION OF THE INVENTION

Various preferred features and embodiments will be described below by way of non-limiting illustration.

The present invention provides a composition as described above. In an embodiment of the present invention a composition can comprise at least one hindered-phenol-containing diester antioxidant wherein said antioxidant is formed from a 3-(3,5-di-t-alkyl-4-hydroxyphenyl)propionic acid or a reactive equivalent thereof and a diol wherein the diol is an amide diol compound, described further below, which can be formed from a monoamine or a polyamine having at least one primary or secondary amino group and a dihydroxy-containing monocarboxylic acid or a reactive equivalent thereof. In another embodiment of the invention the composition containing the hindered-phenol-containing diester antioxidant derived from an amide diol can also comprise an oil of lubricating viscosity as described below and/or one or more other additives as described below to include an alkyl 3-(3,5-di-t-alkyl-4-hydroxyphenyl)propionate.

The present invention can comprise a lubricant composition comprising (A) a major amount of an oil of lubricating viscosity; (B) a minor amount of at least one hindered-phenol-containing diester antioxidant wherein said antioxidant is formed from a 3-(3,5-di-t-alkyl-4-hydroxyphenyl)propionic acid or a reactive equivalent thereof and a diol selected from the group consisting of (1) a hydrocarbon diol compound, (2) an amide diol compound formed from a monoamine or a polyamine having at least one primary or secondary amino group and a dihydroxy-containing monocarboxylic acid or a reactive equivalent thereof, and (3) mixtures thereof; and (C) a minor amount of at least one other additive selected from the group consisting of viscosity modifiers, dispersants, detergents, antiwear agents, antioxidants that are different from component (B), friction modifiers, corrosion inhibitors, foam inhibitors, and mixtures thereof.

The lubricant composition of this invention can find use in various applications to include as a lubricant composition for an internal combustion engine to include a gasoline or spark-ignited engine such as a passenger car engine, a diesel or compression-ignited engine such as a heavy duty diesel truck engine, a natural gas fueled engine such as a stationary power engine, a two-cycle engine, aviation piston and turbine engines, marine and railroad diesel engines; for power transmissions such as an automatic or transaxle or farm tractor transmission; for gears such as industrial or automotive gears; for metalworking; for hydraulic systems; for special applications such as bearings which can require that the lubricant composition be a grease; and for hydrocarbon fuels for an internal combustion engine such as a gasoline or diesel fuel.

Oil of Lubricating Viscosity

The lubricant composition of the present invention can comprise (A) a major amount of an oil of lubricating viscosity. The oil of lubricating viscosity can function by providing lubrication and by serving as a medium to dissolve or disperse the other components or additives of the lubricant composition. The oil of lubricating viscosity can be a single oil or a mixture of two or more oils. The lubricating oil composition comprises of one or more base oils which are generally present in a major amount (i.e. an amount greater than 50 percent by weight). Generally, the base oil is present in an amount greater than 60 percent, or greater than 70 percent, or greater than 80 percent by weight of the lubricating oil composition. In one embodiment the base oil sulfur content can be 0.001 to 0.2 percent by weight, in another embodiment 0.0001 to 0.1 or 0.05 percent by weight.

The lubricating oil composition may have a kinematic viscosity as measured in ASTM D445, of up to about 16.3 $mm^2/s$ at 100° C., and in one embodiment 5 to 16.3 $Mm^2/s$ (cSt) at 100° C., and in one embodiment 6 to 13 $Mm^2/s$ (cSt) at 100° C. In one embodiment, the lubricating oil composition has an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40 or 10W-50.

The lubricating oil composition may have a high-temperature/high-shear viscosity at 150° C. as measured by the procedure in ASTM D4683 of up to 4 $mm^2/s$ (cSt), and in one embodiment up to 3.7 $mm^2/s$ (cSt), and in one embodiment 2 to 4 $mm^2/s$ (cSt), and in one embodiment 2.2 to 3.7 $mm^2/s$ (cSt), and in one embodiment 2.7 to 3.5 $mm^2/s$ (cSt).

The base oil used in the lubricant composition may be a natural oil, synthetic oil or mixture thereof, provided the sulfur content of such oil does not exceed the above-indicated sulfur concentration limit required for the inventive low-sulfur, low-phosphorus, low-ash lubricating oil composition. The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, and propylene isobutylene copolymers); poly(1-hexenes), poly(1-octenes), poly(1-decenes), etc. and mixtures thereof; alkylbenzenes (e.g., dodecylbenzenes, tetradecylbenzenes, dinonylbenzenes, and di-(2-ethylhexyl)benzenes); polyphenyls (e.g., biphenyls, terphenyls, alkylated polyphenyls); alkylated diphenyl ethers and the derivatives, analogs and homologs thereof.

Alkylene oxide polymers and interpolymers and derivatives thereof where the terminal hydroxyl groups have been modified by e.g., esterification, etherifica-tion, constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polypropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-C8 fatty acid esters, or the carboxylic acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, dodecanedioic acid) with a variety of alcohols (e.g., butyl alcohol, hexyl alcohol, dodecyl alcohol, 2-ethylhexyl alcohol, ethylene glycol, diethylene glycol monoether and propylene glycol) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol ethers such as neopentyl glycol, trimethylol propane, pentaerythritol, dipentaerythritol and tripentaerythritol.

The oil can be a poly-alpha-olefin (PAO). Typically, the PAOs are derived from monomers having from 4 to 30, or from 4 to 20, or from 6 to 16 carbon atoms. Examples of useful PAOs include those derived from octene, decene and mixtures thereof. These PAOs may have a viscosity from 2 to 15, or from 3 to 12, or from 4 to 8 $mm^2/s$ (cSt), at 100° C. Examples of useful PAOs include 4 $mm^2/s$ (cSt) at 100° C. poly-alpha-olefins, 6 $mm^2/s$ (cSt) at 100° C. poly-alpha-olefins, and mixtures thereof. Mixtures of mineral oil with one or more of the foregoing PAOs may be used.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Additionally, synthetic oils may be produced by Fischer-Tropsch gas to liquid synthetic procedure as well as other gas-to-liquid oils. In one embodiment the polymer composition of the present invention is useful when employed in a gas-to-liquid oil. Often Fischer-Tropsch hydrocarbons or waxes may be hydroisomerised.

Hindered-Phenol-Containing Diester Antioxidant

The hindered-phenol-containing diester antioxidant of the present invention can be of the formula

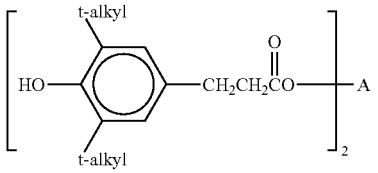

wherein A is a divalent hydrocarbon based group or A is a divalent amide group of the formula

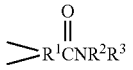

wherein $R^1$ is a trivalent hydrocarbon based group, and $R^2$ and $R^3$ are independently hydrogen or a hydrocarbyl group, where the hydrocarbyl group is defined as a univalent hydrocarbon based group wherein at least one of $R^2$ and $R^3$ is a hydrocarbyl group.

The antioxidant (B) can comprise one or more components or compositions that function as an antioxidant. The antioxidant (B) can comprise or be a minor amount of at least one hindered-phenol-containing diester antioxidant wherein said antioxidant is formed from a 3-(3,5-di-t-alkyl-4-hydroxyphenyl)propionic acid or a reactive equivalent thereof and a diol selected from the group consisting of (1) a hydrocarbon diol compound, (2) an amide diol compound formed from a monoamine or a polyamine having at least one primary or secondary amino group and a dihydroxy-containing monocarboxylic acid or a reactive equivalent thereof, and (3) a mixture thereof. The t-alkyl group of the 3-(3,5-di-t-alkyl-4-hydroxyphenyl)propionic acid or a reactive equivalent thereof of component (B) can have 4 to 12 carbon atoms, and in other instances can have 4 to 10 carbon atoms, or 4 to 8 carbon atoms. In one embodiment of the invention the t-alkyl group or groups of component (B) is a t-butyl group or are t-butyl groups.

The hydrocarbon based group of the hydrocarbon diol compound of (B)(1) can be a divalent group. A hydrocarbon based group can be predominately hydrocarbon in nature and can comprise heteroatoms comprising oxygen, nitrogen, or a mixture thereof in the hydrocarbon chain or attached to the hydrocarbon chain as separate atoms such as for example oxygen as part of a carbonyl group or as a group such as for example an alkoxy group. The hydrocarbon based group can have 2 or more carbon atoms, and in other instances can have 3 or more carbon atoms, 2 to 30 carbon atoms, 3 to 30 carbon atoms, 3 to 24 carbon atoms, 6 to 20 carbon atoms, or 8 to 16 carbon atoms. The hydrocarbon based group can be saturated, unsaturated, linear, branched or a mixture thereof. The 2 hydroxy groups of the hydrocarbon diol compound can be located anywhere along the carbon chain to include, for example, 1,2- and 1,3- and 1,4- and 1,5- and 1,6- and 1,7- and 1,8- and 1,9- and 1,10-diols as well as diols having the 2 hydroxy groups at the terminal carbons of the chain. In one embodiment of the invention the hydrocarbon diol compound is a 1,2-hydrocarbon diol compound or a 1,2-alkanediol to include, for example, 1,2-octanediol and 1,2-decanediol, 1,2 hexadecandiol and 1,2-tetradecanediol. In another embodiment of the invention the diester antioxidant (B) can be formed from a hindered-phenol substituted propionic acid and an alkylene oxide such as for example ethylene oxide or 1,2-epoxydecane.

The amide diol compound of (B)(2) can be formed from an amine having at least one primary or secondary amino group and a monocarboxylic acid or reactive equivalent thereof, such as for example a carboxylate ester, where the monocarboxylic acid or reactive equivalent thereof (that is, the dihydroxy-containing monocarboxylic acid) contains 2 hydroxy groups on a hydrocarbon chain attached to the carboxyl group —$CO_2H$ or reactive equivalent thereof such as an ester group —$CO_2R$ where R is an alkyl group. The amine can be a monoamine or can be a polyamine having 2 or more amino groups. The monoamine can be a primary or secondary amine having 1 or 2 hydrocarbyl groups. The hydrocarbyl groups of the monoamine can have 1 to 30 carbon atoms, and in other embodiments can have 6 to 26 carbon atoms or 8 to 22 carbon atoms. The hydrocarbyl groups can be saturated, unsaturated, linear, branched or a mixture thereof. The monoamine can be a polyetheramine or a thioether-containing amine. The monocarboxylic acid of (B)(2) can have 3 or more, 4 or more, or 5 or more carbon atoms. In embodiments of the invention the monocarboxylic acid of (B)(2) can be a 2,2-bis(hydroxymethyl) -substituted monocarboxylic acid or reactive equivalent thereof where the acid can have 3 to 28, 4 to 24, or 4 to 20 carbon atoms. In one embodiment of the invention the amide diol of (B)(2) is formed from a primary monoamine and a 2,2-bis(hydroxymethyl)-substituted monocarboxylic acid, and in another embodiment the amide diol of (B)(2) is formed from a primary monoamine having 8 to 22 carbon atoms and a 2,2-bis(hydroxymethyl)-substituted monocarboxylic acid having 4 to 20 carbon atoms. The amide diol of (B)(2) can be prepared by methods known to those skilled in the art to include reacting a mixture of the amine and the dihydroxy-containing monocarboxylic acid generally in a mole ratio of about 1:1 at 90 to 250° C. optionally in the presence of an aromatic solvent such as toluene while removing water from the reaction.

The hindered-phenol-containing diester antioxidant of (B) can be formed from as described above a 3-(3,5-di-t-alkyl-4-hydroxyphenyl)propionic acid or a reactive equivalent thereof, comprising an alkyl 3-(3,5-di-t-alkyl-4-hydroxyphenyl)propionate where the alkyl group of the ester moiety can have 1 to 10, 1 to 6, or 1 to 3 carbon atoms, and a diol of (B)(1), (B)(2) or (B)(3). In embodiments of the invention the antioxidant (B) is formed from 3-(3,5-di-t-butyl-4-hydroxyphenyl)propionic acid or a reactive equivalent thereof including an alkyl 3-(3,5-di-t-butyl-4-hydroxyphenyl)propionate and a 1,2-alkanediol or a 1,2-alkanediol having 4 to 36 or 8 to 16 carbon atoms. In other embodiments of the invention the antioxidant (B) is formed from 3-(3,5-di-t-butyl-4-hydroxyphenyl)propionic acid or a reactive equivalent thereof including an alkyl 3-(3,5-di-t-butyl-4-hydroxyphenyl)propionate and an amide diol formed from a primary monoamine and a 2,2-bis(hydroxymethyl)-substituted monocarboxylic acid or an amide diol formed from a primary monoamine having 8 to 22 carbon atoms and a 2,2-bis(hydroxymethyl)-substituted monocarboxylic acid having 4 to 20 carbon atoms. The diester antioxidant (B) can be prepared by methods known to those skilled in the art to include esterification using an acid catalyst of a 3-(3,5-di-t-alkyl-4-hydroxyphenyl) propionic acid with a (B)(1), (B)(2) or (B)(3) diol or transesterification using an acid or base catalyst of an alkyl 3-(3,5-di-t-alkyl-4-hydroxyphenyl)propionate with a (B)(1), (B)(2) or (B)(3) diol. The diester antioxidant of (B) can be prepared by transesterifying an alkyl 3-(3,5-di-t-alkyl-4-hydroxyphenyl)propionate such as the methyl ester of 3-(3,5-di-t-butyl-4-hydroxyphenyl)propionic acid with a diol of (B)(1), (B)(2) or (B)(3) using a base catalyst such as titanium (IV) isopropoxide where the mole ratio of ester to diol is generally about 2:1. The base catalyst for the transesterification can comprise, for example, metal alkoxides such as titanium (IV) isopropoxide and aluminum isopropoxide and potassium t-butoxide, organometal oxides such as dibutyltin oxide, and metal carbonate salts such as potassium carbonate. The diester antioxidant (B) can be present on a weight basis in the lubricant composition of this invention at 0.1 to 10%, 0.3 to 8%, or 0.6 to 6%.

Other Additive(s)

The lubricant composition of the invention can comprise (C) a minor amount of at least one other additive. The other additive (C) can comprise a member selected from the group consisting of a viscosity modifier, a pour point depressant, a dispersant, a detergent, an antiwear agent, an antioxidant that is different from component (B), a friction modifier, a corrosion inhibitor, a seal swell agent, a metal deactivator, a foam inhibitor, and a mixture thereof. The mixture of other additives can be 2 or more additives of the same type such as for example a sulfonate and phenate detergent, 2 or more additives of different types such as for example a detergent and dispersant and antiwear agent, or 2 or more additives of the same type as well as 2 or more additives of different types such as for example a sulfonate and phenate detergent and a dispersant and an antiwear agent.

The lubricant composition of the present invention may contain one or more dispersants.

(1) Carboxylic dispersants are reaction products of carboxylic acylating agents (acids, anhydrides, esters, etc.) containing at least 34 and preferably at least 54 carbon atoms which are reacted with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imide, amide, and ester reaction products of carboxylic ester dispersants.

(2) Succinimide dispersants are a species of carboxylic dispersants. They are the reaction product of a hydrocarbyl substituted succinic acylating agent with an organic hydroxy compound or, an amine containing at least one hydrogen attached to a nitrogen atom, or a mixture of said hydroxy compound and amine. The term "succinic acylating agent" refers to a hydrocarbon-substituted succinic acid or succinic acid-producing compound (which term also encompasses the acid itself). Such materials typically include hydrocarbyl-substituted succinic acids, anhydrides, esters (including half esters) and halides.

Succinic based dispersants have a wide variety of chemical structures including typically structures such as

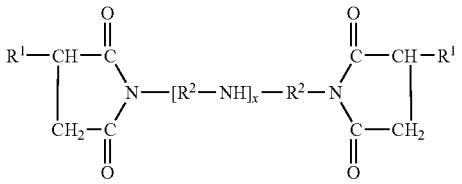

In the above structure, each $R^1$ is independently a hydrocarbyl group, such as a polyolefin-derived group having an $\overline{M}_n$ of 500 or 700 to 10,000. Typically the hydrocarbon based group is an alkyl group, frequently a polyisobutylene group with a molecular weight of 500 or 700 to 5000, or alternatively 1500 or 2000 to 5000. Alternatively expressed, the $R^1$ groups can contain 40 to 500 carbon atoms, for instance at least 50, e.g., 50 to 300 carbon atoms, such as aliphatic carbon atoms. The $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435, 3,172,892 and 6,165,235.

Additional details and examples of the procedures for preparing the succinimide dispersants of the present invention are included in, for example, U.S. Pat. Nos. 3,172,892, 3,219,666, 3,272,746, 4,234,435, 6,440,905 and 6,165,235.

(3) "Amine dispersants" are reaction products of relatively high molecular weight aliphatic halides and amines, preferably polyalkylene polyamines. Examples thereof are described, for example, in the following U.S. Pat. Nos. 3,275,554, 3,438,757, 3,454,555, and 3,565,804.

(4) "Mannich dispersants" are the reaction products of alkyl phenols in which the alkyl group contains at least 30 carbon atoms with aldehydes (especially formaldehyde) and amines (especially polyalkylene polyamines). The materials described in the following are illustrative U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(5) Post-treated dispersants are obtained by reacting carboxylic, amine or Mannich dispersants with reagents such as dimercaptothiadiazoles, urea, thiourea, carbon disulfide, aldehydes, ketones, carboxylic acids, hydrocarbon-substituted succinic anhydrides, nitriles epoxides, boron compounds, phosphorus compounds or the like. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

(6) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, 3449,250, 3,519,656, 3,666,730, 3,687,849, and 3,702,300.

The composition can also contain one or more detergents, which are normally salts, and specifically overbased salts. Such overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment the lubricant of the present invention can contain an overbased sulfonate detergent. Suitable sulfonic acids include sulfonic and thio-sulfonic acids. Sulfonic acids include the mono- or polynuclear aromatic or cyclo-aliphatic compounds. Oil-soluble sulfonates can be represented for the most part by one of the following formulas: $R_2$-T-$(SO_3^-)_a$ and $R_3$—$(SO_3^-)_b$, where T is a cyclic nucleus such as typically benzene; $R_2$ is an aliphatic group such as alkyl, alkenyl, alkoxy, or alkoxyalkyl; $(R_2)$+T typically contains a total of at least about 15 carbon atoms; and $R_3$ is an aliphatic hydrocarbon based group typically containing at least 15 carbon atoms. Examples of $R_3$ are alkyl, alkenyl, alkoxyalkyl, and carboalkoxyalkyl groups. The groups T, $R_2$, and $R_3$ in the above formulas can also contain other inorganic or organic substituents in addition to those enumerated above such as, for example, hydroxy, mercapto, halogen, nitro, amino, nitroso, sulfide, or disulfide. In the above formulas, a and b are at least 1.

Another overbased material which can be present is an overbased phenate detergent. The phenols useful in making phenate detergents can be represented by the formula $(R_1)_a$—Ar—$(OH)_b$, wherein $R_1$ is defined above; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R_1$ and a are typically such that there is an average of at least 8 aliphatic carbon atoms provided by the $R_1$ groups for each phenol compound. Phenate detergents are also sometimes provided as sulfur-bridged species.

In one embodiment, the overbased material is an overbased detergent selected from the group consisting of overbased salixarate detergents, overbased saligenin detergents, overbased salicylate detergents, and overbased glyoxylate detergents, and mixtures thereof. Overbased saligenin detergents are commonly overbased magnesium salts which are based on saligenin derivatives. A general example of such a saligenin derivative can be represented by the formula

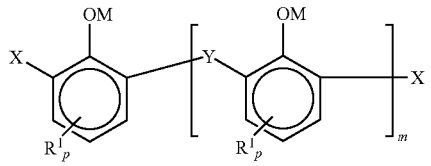

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion, $R^1$ is a hydrocarbon based group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Other metals include alkali metals such as lithium, sodium, or potassium; alkaline earth metals such as calcium or barium; and other metals such as copper, zinc, and tin.

As used herein, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" is expressly intended to encompass such variations.

Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear compound comprising at least one unit of formula (I) or formula (II):

(I)

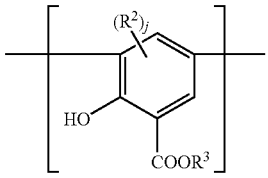

(II)

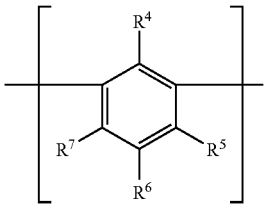

each end of the compound having a terminal group of formula (III) or formula (IV):

(III)

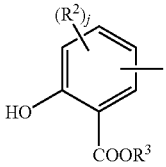

(IV)

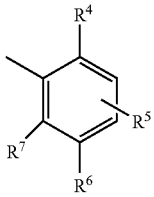

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbon based group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

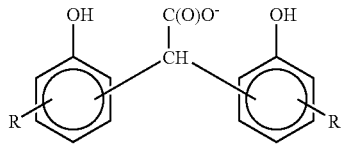

and more specifically,

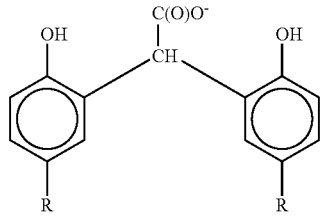

wherein each R is independently an alkyl group containing at least 4, and preferably at least 8 carbon atoms, provided that the total number of carbon atoms in all such R groups is at least 12, preferably at least 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid and other omega-oxoalkanoic acids. Overbased glyoxylic detergents and their methods of preparation are disclosed in greater detail in U.S. Pat. No. 6,310,011 and references cited therein.

Another detergent can be a salicylate detergent. The alkylsalicylate can be an alkali metal salt or an alkaline earth metal salt of an alkylsalicylic acid which can in turn be prepared from an alkylphenol by Kolbe-Schmitt reaction. The alkylphenol can be prepared by a reaction of α-olefin having 8 to 30 carbon atoms (mean number) with phenol. Alternatively, calcium salicylate can be produced by direct neutralization of alkylphenol and subsequent carbonation.

In another embodiment of the invention component (C) can comprise an antioxidant comprising a member selected from the group consisting of a hindered phenol that is different from component (B), a diarylamine, a sulfurized olefinic compound, and a mixture thereof. In additional embodiments of the invention the antioxidant can comprise an alkyl 3-(3,5-di-t-alkyl-4-hydroxyphenyl)propionate, an alkyl 3-(3,5-di-t-butyl-4-hydroxyphenyl)propionate, or an alkyl 3-(3,5-di-t-butyl-4-hydroxyphenyl)propionate where the alkyl group of the ester moiety has 1 or more carbon atoms, 2 or more carbon atoms, 2 to 30 carbon atoms, 2 to 20 carbon atoms, or 2 to 10 carbon atoms. Component (C) can comprise an antiwear agent. The antiwear agent can comprise a zinc dialkyldithiophosphate. The other additive or additives of component (C) can each be present in the lubricant composition on a weight basis at 0.001 to 14%, 0.001 to 11%, or 0.001 to 8%.

Sulfur, Phosphorus, Ash Content

The present invention provides a composition as described above. Often the composition has total sulfur content in one embodiment below 0.5 percent by weight, in another embodiment below 0.4 percent by weight, in another embodiment below 0.3 percent by weight, in yet another embodiment 0.2 percent by weight or less and in yet another embodiment 0.1 percent by weight or less. Often the major source of sulfur in the composition of the invention is derived from conventional diluent oil. Typical ranges for the total sulfur content are 0.5 or 0.1 to 0.01 percent by weight.

Often the composition has a total phosphorus content of less than or equal to 1400 ppm, in another embodiment equal to or less than 1200 ppm, in another embodiment equal to or less than 1000, in another embodiment equal to or less than 800 ppm, in another embodiment equal to or less than 500 ppm, in yet another embodiment equal to or less than 300 ppm, in yet another embodiment equal to or less than 200 ppm and in yet another embodiment equal to or less than 100 ppm of the composition. In yet another embodiment the total phosphorus content is 100 to 600 ppm. A typical range for the total phosphorus content is 100 to 1400 ppm.

Often the composition has a total sulfated ash content as determined by ASTM D-874 of below 1.2 percent by weight, in one embodiment equal to or less than 1.0, in other embodiment equal to or less than 0.7 percent by weight, in yet another embodiment equal to or less than 0.4 percent by weight, in yet another embodiment equal to or less than 0.3 percent by weight and in yet another embodiment equal to or less than 0.05 percent by weight of the composition. In yet another embodiment the total sulfated ash content is 0.1 to 0.8 percent by weight of the composition. A typical range for the total sulfate ash content is 0.05 to 1.2 percent by weight.

Lubricant Composition

The lubricant composition can be a lubricant composition for an application comprising those listed above. In one embodiment of the invention the lubricant composition can be a lubricant composition for an internal combustion engine. The internal combustion engine can comprise a spark-ignited engine or a compression-ignited engine.

Concentrate Composition

Components (B) and (C) of the invention can be combined in a concentrated form as a concentrate composition for convenient and efficient handling and shipping prior to being diluted in a base stock or oil of lubricating viscosity for use in a lubricant composition for an application. A concentrate composition of the present invention can comprise a concentrate-forming amount of an oil of lubricating viscosity, at least one hindered-phenol-containing diester antioxidant as described above, and at least one other additive as described above. Each of the antioxidant and other additive or additives can be present in the concentrate composition on a weight basis at 1 to 99%, 5 to 85%, or 10 to 75%. The oil of lubricating viscosity can be present in the concentrate composition on a weight basis at 99 to 1%, 95 to 15%, or at 90 to 25%.

Preparation of Compositions

The lubricant and concentrate compositions of the invention can be prepared by admixing or mixing, usually with a mixing device, the components in any suitable order from ambient to an elevated temperature of 60° C., 80° C., or 100° C. until the composition is homogeneous or the components are dispersed.

Method for Improving Lubricant Composition Performance

A method of the present invention for improving the performance of a lubricant composition comprises incorporating into the lubricant composition a performance-improving amount of a diester antioxidant as described above where the lubricant composition comprises an oil of lubricating viscosity and at least one other additive as described above. The improvement in performance can comprise a decrease in volatility, an increase in oxidation inhibition, a reduction in deposits, or a combination thereof. The lubricant composition can be a lubricant composition for an internal combustion engine. The internal combustion engine can comprise a spark-ignited engine or a compression-ignited engine. The spark-ignited or compression-ignited engine can have an exhaust gas recirculation system. The spark-ignited or compression-ignited engine can have at least one exhaust treatment device comprising a catalytic converter, a catalyzed diesel particulate trap, a noncatalyzed diesel particulate trap, a diesel oxidation catalyst, a selective catalytic reduction catalyst, a lean $NO_x$ catalyst, or a combination thereof. The lubricant composition can have normal or reduced levels of sulfated ash, phosphorus and sulfur as described above.

EXAMPLES

The invention will be further illustrated by the following examples, which set forth particularly advantageous embodiments. While the examples are provided to illustrate the present invention, they are not intended to limit it.

Volatility and Antioxidation Evaluations

Fully formulated engine oils containing either a hindered phenol antioxidant of the invention derived from an alkanediol or a comparative hindered phenol antioxidant derived from a monohydric alcohol or an amine diol are evaluated for volatility performance in ASTM (American Society for Testing and Materials) Test D5800—a standard test method for evaporative loss of lubricating oils by the Noack Method. These engine oils are low in sulfated ash, sulfur and phosphorus content and differ in the composition of the hindered phenol.

TABLE 1

| | Hindered | ASTM D5800, % Evaporative Loss[4] | | | | |
|---|---|---|---|---|---|---|
| Example | Phenol Type | 2% HP | 3% HP | 4% HP | 6% HP | 10% HP |
| 1 (comparative) | Monohydric[1] | 10.5 | 10.2 | 11.6 | 13.4 | 15.0 |
| 2 (comparative) | Amine Diol[2] | 9.6 | 9.7 | 9.1 | 9.6 | 8.7 |
| 3 | AlkaneDiol[3] | 9.1 | 9.4 | 9.1 | 9.6 | 9.1 |

[1]The engine oil of Example 1 contains a hindered phenol, butyl 3-(3,5-di-t-butyl-4-hydroxyphenyl)propionate, derived from a monohydric alcohol.

[2]The engine oil of Example 2 contains a hindered phenol, N-octadecyldiethanolamine bis(3-(3,5-di-t-butyl-4-hydroxyphenyl)propionate), derived from an amine diol. Example 2 relates to compounds of the formula I TABLE 1-continued

| Example | Hindered Phenol Type | ASTM D5800, % Evaporative Loss[4] 2% HP | 3% HP | 4% HP | 6% HP | 10% HP |
|---|---|---|---|---|---|---|

I

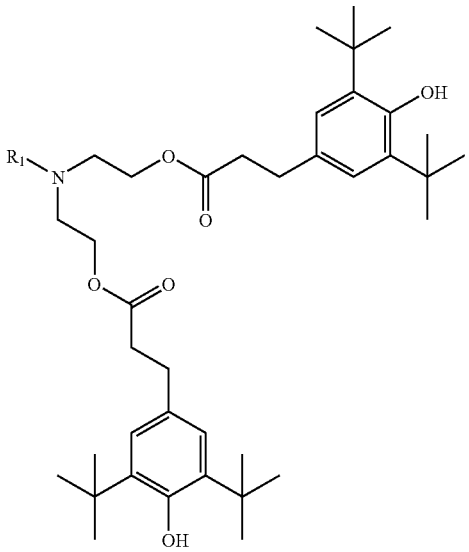

wherein, when $R_1$ is $C_{18}H_{35}$ (Oleyl). However, $R_1$ could be any length, branch or unbranched, saturated or unsaturated, and/or contain heteroatoms.

[3]The engine oil of Example 3 contains a hindered phenol, 1,2-decanediol bis(3-(3,5-di-t-butyl-4-hydroxyphenyl)propionate), derived from an alkanediol. Example 3 relates to compounds of the formula II

II

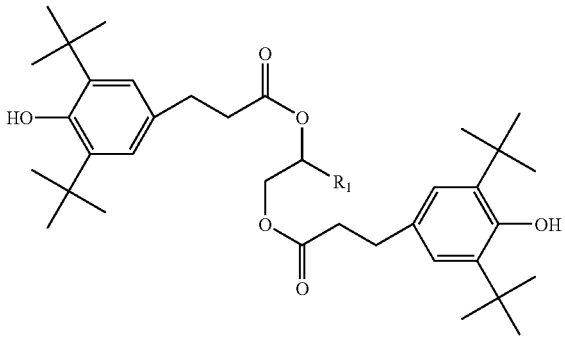

wherein, when $R_1$ is $C_8$ to $C_{14}$. However, $R_1$ could be any length, branch or unbranched, saturated or unsaturated, and/or contain heteroatoms.

[4]Weight percent evaporative loss, as measured by ASTM D5800 Noack Method Test, by an engine oil containing 2 to 10 wt. % of the hindered phenol (HP). A lower % evaporative loss is a better result.

Fully formulated engine oils containing 3% by weight of either a hindered phenol antioxidant of the invention derived from an alkanediol or amide diol or a comparative hindered phenol antioxidant derived from a monohydric alcohol or amine diol are evaluated for antioxidation performance in the Komatsu Hot Tube Test—an industry test used to evaluate antioxidation performance of engine oils based on their deposit-forming tendencies by circulating a sample of the engine oil at 0.31 cc per hour and air at 10 cc per minute through a glass tube for 16 hours at 275, 280 or 290° C. These engine oils are low in sulfated ash, phosphorus, and sulfur content and differ in the composition of the hindered phenol.

TABLE 2

| Example | Hindered Phenol Type | Komatsu Hot Tube Test[5] 280° C. | 290° C. |
|---|---|---|---|
| 1 (Comparative) | Monohydric[1] | 3.0, 3.5 | 0.5, 1.0 |
| 2 (Comparative) | Amine Diol[2] | 3.0 | 1.0 |
| 3 | AlkaneDiol[3] | 9.0 | 8.8 |
| 4 | Amide Diol[4] | 8.5 | 7.5 |

[1]The engine oil of Example 1 contains 3 wt. % hindered phenol, butyl 3-(3,5-di-t-butyl-4-hydroxyphenyl)propionate, derived from a monohydric alcohol.

[2]The engine oil of Examples 2 contains 3 wt. % hindered phenol, N-octadecyldiethanolamine bis(3-(3,5-di-t-butyl-4-hydroxyphenyl)propionate), derived from an amine diol. Example 2 relates to compounds of the formula III

III

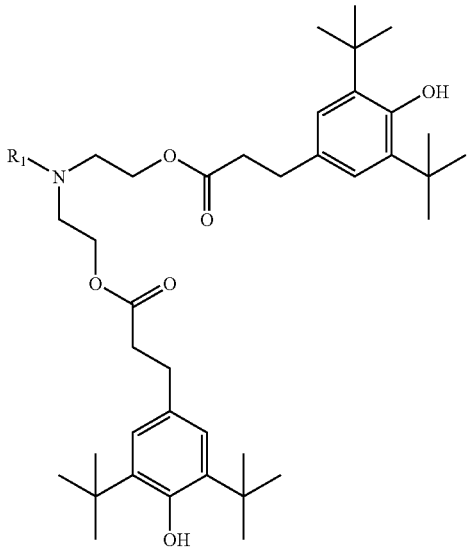

wherein, when $R_1$ is $C_{18}H_{35}$ (Oleyl). However, $R_1$ could be any length, branch or unbranched, saturated or unsaturated, and/or contain heteroatoms.

[3]The engine oil of Example 3 contains 3 wt. % hindered phenol, 1,2-decanediol bis(3-(3,5-di-t-butyl-4-hydroxyphenyl)propionate), derived from an alkanediol. Example 3 relates to compounds of the formula IV

IV

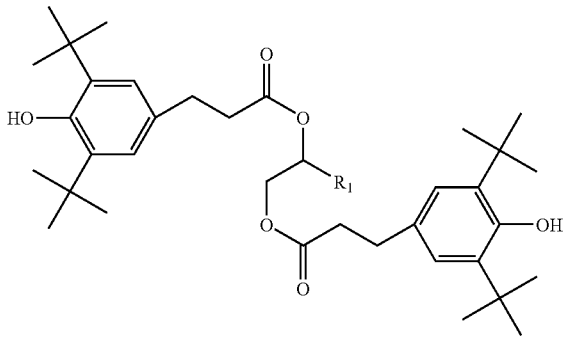

wherein, when $R_1$ is $C_8$ to $C_{14}$. However, $R_1$ could be any length, branch or unbranched, saturated or unsaturated, and/or contain heteroatoms.

[4]The engine oil of Example 4 contains 3 wt. % hindered phenol, N-oleyl 2,2-dihydroxymethylpropionamide bis(3-(3,5-di-t-butyl-4-hydroxyphenyl)propionate), derived from an amide diol. Example 4 relates to compounds of the formula V TABLE 2-continued

| Example | Hindered Phenol Type | Komatsu Hot Tube Test[5] 280° C. | 290° C. |
|---|---|---|---|
| V | 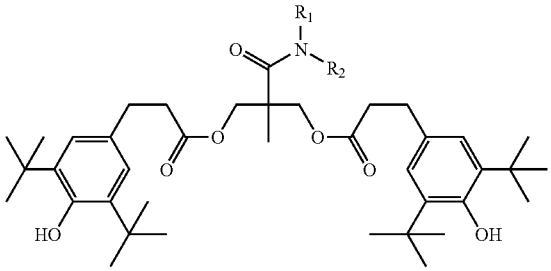 | | |

wherein, when $R_1$ is $C_{18}H_{35}$ (Oleyl) and $R_2$ = H. However, $R_1$ or $R_2$ could be any length, branch or unbranched, saturated or unsaturated, and/or contain heteroatoms.

[5]Komatsu Hot Tube Test deposit rating at 280 and 290° C. A higher number is a better rating with 10 representing a clean tube and 0 (zero) representing a tube with heavy deposits.

Each of the documents referred to in this Detailed Description of the invention section is incorporated herein by reference. All numerical quantities in this application used to describe or claim the present invention are understood to be modified by the word "about" except for the examples or where explicitly indicated otherwise. All chemical treatments or contents throughout this application regarding the present invention are understood to be as actives unless indicated otherwise even though solvents or diluents may be present.

What is claimed is:

1. A lubricant composition, comprising:

(A) a major amount of an oil of lubricating viscosity;

(B) a minor amount of at least one hindered-phenol-containing diester antioxidant wherein said antioxidant is formed from a 3-(3,5-di-t-alkyl-4-hydroxyphenyl)propionic acid or a reactive equivalent thereof and a 1,2-alkanediol; and (C) a minor amount of at least one other additive selected from the group consisting of viscosity modifiers, pour point depressants, dispersants, detergents, antiwear agents, antioxidants that are different from component (B), friction modifiers, corrosion inhibitors, seal swell agents, metal deactivators, foam inhibitors, and mixtures thereof.

2. The lubricant composition of claim 1 wherein the antioxidant of component (B) is at least one compound of the formula

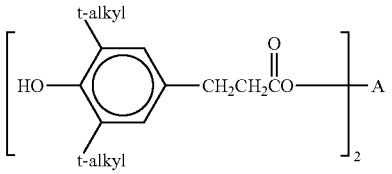

wherein A is a divalent hydrocarbon based group derived from a 1,2-alkanediol.

3. The lubricant composition of claim 1 wherein the 3-(3,5-di-t-alkyl-4-hydroxyphenyl)propionic acid or reactive equivalent thereof is 3-(3,5-di-t-butyl-4-hydroxyphenyl)propionic acid or an alkyl ester thereof.

4. The lubricant composition of claim 1 wherein the alkanediol has about 4 to about 36 carbon atoms.

5. The lubricant composition of claim 1 wherein the antioxidant is formed from 3-(3,5-di-t-butyl-4-hydroxyphenyl) propionic acid or a reactive equivalent thereof and a 1,2-alkanediol having about 8 to about 16 carbon atoms.

6. The lubricant composition of claim 1 wherein component (C) comprises a dispersant wherein the dispersant is a reaction product of a hydrocarbyl-substituted succinic acylating agent and a polyethylenepolyamine wherein the hydrocarbyl substituent is derived from a polyisobutylene having a number average molecular weight of about 900 to about 2,500.

7. The lubricant composition of claim 1 wherein component (C) comprises an antioxidant selected from the group consisting of hindered phenols that are different from component (B), diarylamines, sulfurized olefinic compounds, and mixtures thereof.

8. The lubricant composition of claim 7 wherein component (C) comprises an alkyl 3-(3,5-di-t-alkyl-4-hydroxyphenyl)propionate.

9. The lubricant composition of claim 1 wherein component (C) comprises an antiwear agent comprising a zinc dialkyldithiophosphate.

10. The lubricant composition of claim 1 wherein the lubricant composition is a lubricant composition for an internal combustion engine.

11. The lubricant composition of claim 10 wherein the lubricant composition has on a weight basis a sulfated ash content of less than about 1.2%, a phosphorus content of less than about 0.12%, and a sulfur content of less than about 0.5%.

12. A concentrate composition, comprising:

(A) a concentrate-forming amount of an oil of lubricating viscosity;

(B) at least one hindered-phenol-containing diester antioxidant wherein said antioxidant is formed from a 3-(3,5-di-t-alkyl-4-hydroxyphenyl)propionic acid or a reactive equivalent thereof and a 1,2-alkanediol; and (C) at least one other additive selected from the group consisting of viscosity modifiers, pour point depressants, dispersants, detergents, antiwear agents, antioxidants that are different from component (B), friction modifiers, corrosion inhibitors, seal swell agents, metal deactivators, foam inhibitors, and mixtures thereof.

13. A method of operating an internal combustion engine, comprising:

(A) supplying to said engine a lubricant comprising:

(i) an oil of lubricating viscosity;

(ii) at least one hindered-phenol-containing diester antioxidant wherein said antioxidant is formed from a 3-(3,5-di-t-alkyl-4-hydroxyphenyl)propionic acid or a reactive equivalent thereof a 1,2-alkanediol; and (iii) a minor amount of at least one other additive selected from the group consisting of viscosity modifiers, pour point depressants, dispersants, detergents, antiwear agents, antioxidants that are different from component (ii), friction modifiers, corrosion inhibitors, seal swell agents, metal deactivators, foam inhibitors, and mixtures thereof.

14. The method of claim 13 wherein the engine is a compression-ignited engine having an exhaust gas recirculation system and at least one exhaust treatment device.

* * * * *